United States Patent [19]

Hefty

[11] Patent Number: 4,999,862

[45] Date of Patent: Mar. 19, 1991

[54] WHEELCHAIR MOUNTED INVALID LIFT

[76] Inventor: James C. Hefty, 3540 Akula Dr., Anchorage, Ak. 99516

[21] Appl. No.: 421,368

[22] Filed: Oct. 13, 1989

[51] Int. Cl.[5] ..... A61G 7/10

[52] U.S. Cl. ..... 5/81 R; 5/83; 5/86; 5/87; 5/89; 280/304.1

[58] Field of Search ..... 5/81 R, 81 B, 83, 84, 5/86, 87, 89, 445; 280/304.1; 414/921

[56] References Cited

U.S. PATENT DOCUMENTS

| | | | |
|---|---|---|---|
| 953,962 | 4/1910 | Lane | 5/89 X |
| 2,272,778 | 2/1942 | Reuter | 5/89 X |
| 2,663,031 | 12/1953 | Kalthoff | 5/89 |
| 3,063,736 | 11/1962 | Landig | 280/304.1 |
| 3,638,647 | 2/1972 | Creelman | 5/81 R X |
| 3,758,894 | 9/1973 | Finley | 5/81 R X |
| 4,141,094 | 1/1979 | Ferguson et al. | 5/81 R |
| 4,288,124 | 9/1981 | Hamilton | 5/81 R X |
| 4,530,122 | 7/1985 | Sanders et al. | 5/83 |
| 4,739,526 | 4/1988 | Hollick | 5/83 |

FOREIGN PATENT DOCUMENTS

| | | | |
|---|---|---|---|
| 1094405 | 12/1917 | United Kingdom | 5/81 R |

*Primary Examiner*—Michael F. Trettel
*Attorney, Agent, or Firm*—Michael John Tavella

[57] ABSTRACT

A lifting mechanism for invalid patients, confined to wheel chairs is disclosed. The device is integrally connected to the wheelchair rather than being fixed in one place. This permits the patient to be moved within a home, doctor's office or hospital without having to bring the patient to such a fixed-in-place lifting device. The invention uses an outrigger support to ensure stability of the wheel chair while the device is in operation. The device is typically powered by the battery commonly found on self propelled wheelchairs. Of course, for manual wheelchairs, a battery can be installed if needed. The device uses a sling to cradle the patient. The sling is attached to a lifting bar, which is placed at the end of the lift cable. A motor is used to retract or extend the cable as needed and to lift and hold the patient. The patient is lifted to a safe height above the chair, and the motor is slid along a track to the end of a cantilever beam. The patient can then be lowered to a bed, jacuzzi, or other treatment facility as needed. To return the patient to the wheelchair, the reverse procedure is employed. The device is designed to disassemble for travel in vans or airplanes.

13 Claims, 4 Drawing Sheets

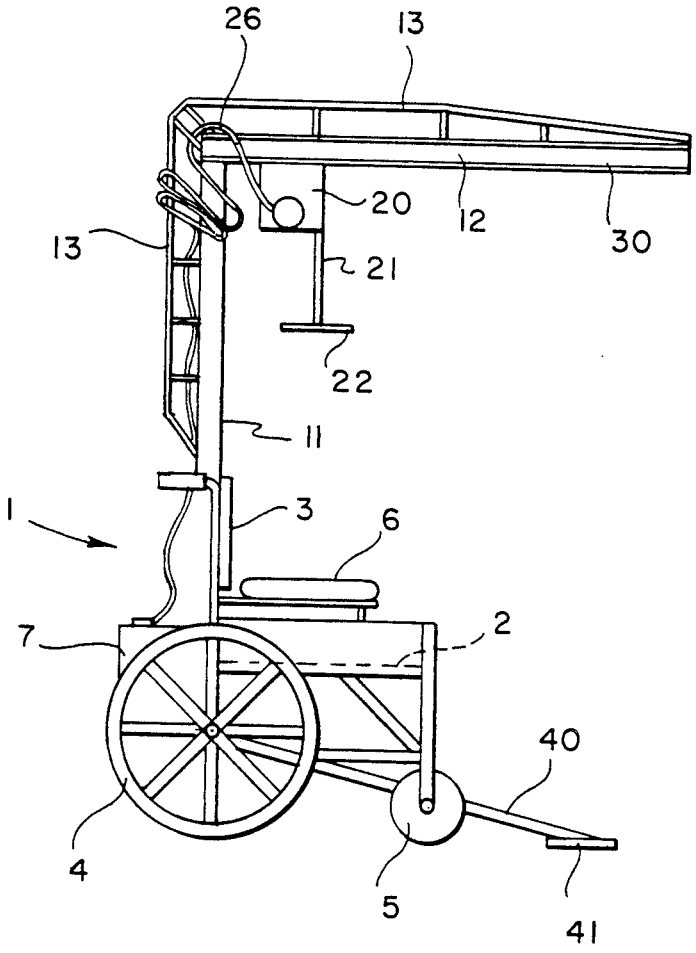
FIG. 1
FIG. 2
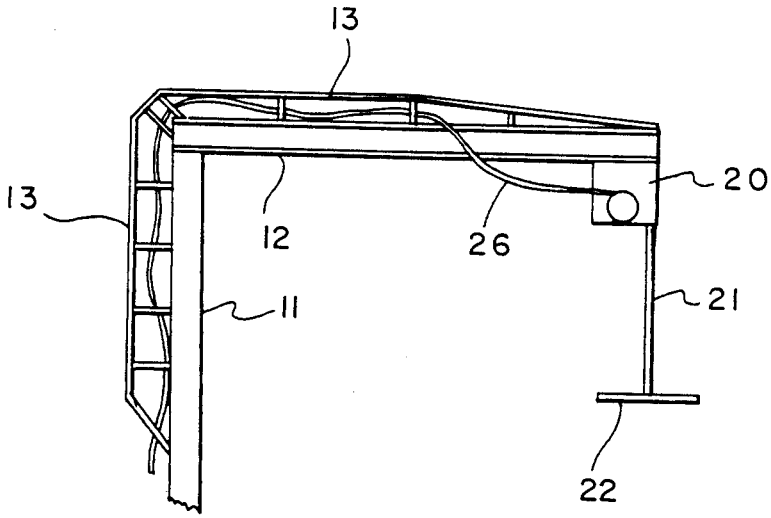

WHEELCHAIR MOUNTED INVALID LIFT

This invention relates to invalid lifting devices and particularly to lifting devices that are mounted to wheelchairs.

BACKGROUND OF THE INVENTION

Invalids confined to wheel chairs often have difficulty in moving from the wheelchair to other locations such as a bed, or toilet. People are needed to assist patients from the chairs. Often, the people responsible for the patients, especially in the home environment, have difficulty in assisting the patient from the wheelchair to the other locations. To assist in moving patients, several devices have been developed to lift and transport invalids from place to place, inlcuding wheelchairs. Examples of these devices are found in U.S. Pat. Nos. 3,222,029 to Hildemann, 3,351,959 to Turpin, 4,125,908 to Vail et al. and 4,571,758 to Samuelsson. French Patent No. 2,414,909 to Jouk. These devices fall into two distinct categories. The French Patent and Hildemann are examples of frame type devices that are mounted on wheels. These devices can be moved and positioned next to the wheelchair or bed as needed and the patient can be lifted using a harness and the hoist mounted on the frame. Both of these devices are compact and will not lift the patient sufficiently off the ground. Also, once the patient is in the harness, the entire frame must be moved to wherever the patient is to be relocated. This compact device is uncomfortable and embarrassing for patients to use.

The Turpin, and Vail designs teach a movable hoist mounted on a ceiling, for example. The patient would be lifted in a harness and moved to the new location by following the track in the ceiling. These devices appear to operate better because they can position the patient in a more comfortable and less embarrassing position. The Samuelsson device takes the concept one step farther. The Samuelsson device has a cantilever arm that is mounted to a central pedestal. The arm has a track mounted hoist attached to it to pick up patients. The pedestal has a telescoping column that can raise and lower the arm as needed. Finally, unlike the fixed tracks of Turpin and Vail, the pedestal column is designed to rotate over a 360 degree radius. This device offers several advantages. However, its biggest drawback is that it is fixed in place. Thus, it can be installed in a physical therapy room for example, where it will be used often. It cannot be relocated for temporary service elsewhere, however.

All of these devices provide service in hospitals or other medical type locations. They are, however, cumbersome to use in the home environment. Also, when traveling, the devices must be packed and carried with the patient, which is inconvenient at best.

SUMMARY OF THE INVENTION

The present invention overcomes the limitations of the devices mentioned above. The device consists of a cantilever lifting arm that is mounted to the wheel chair, a motor operated hoist that is track mounted to the lifting arm, a harness for lifting patients, and an outrigger, attached to the wheel chair, that provides support for the lifting arm. The device is intended to be used on any commerical powered wheelchair. The motor on the hoist is powered by the battery used to drive the chair.

It is an object of this invention to provide an integral lifting arm of a wheelchair.

It is another object of this invention to provide an integral lifting arm that can be dismantled for travel purposes and readily resembled as needed.

It is another object of this invention to provide an integral lifting arm that is powered by a power source attached to the wheelchair itself.

BRIEF DESCRIPTION OF THE DRAWINGS

FIG. 1 is a side view of the device attached to a wheelchair with the motor placed in the rear position and the outrigger support extended.

FIG. 2 is a side view of the upper portion of the device showing the motor extended to the far front position.

DETAILED DESCRIPTION OF THE PREFERRED EMBODIMENT

Figure 3:
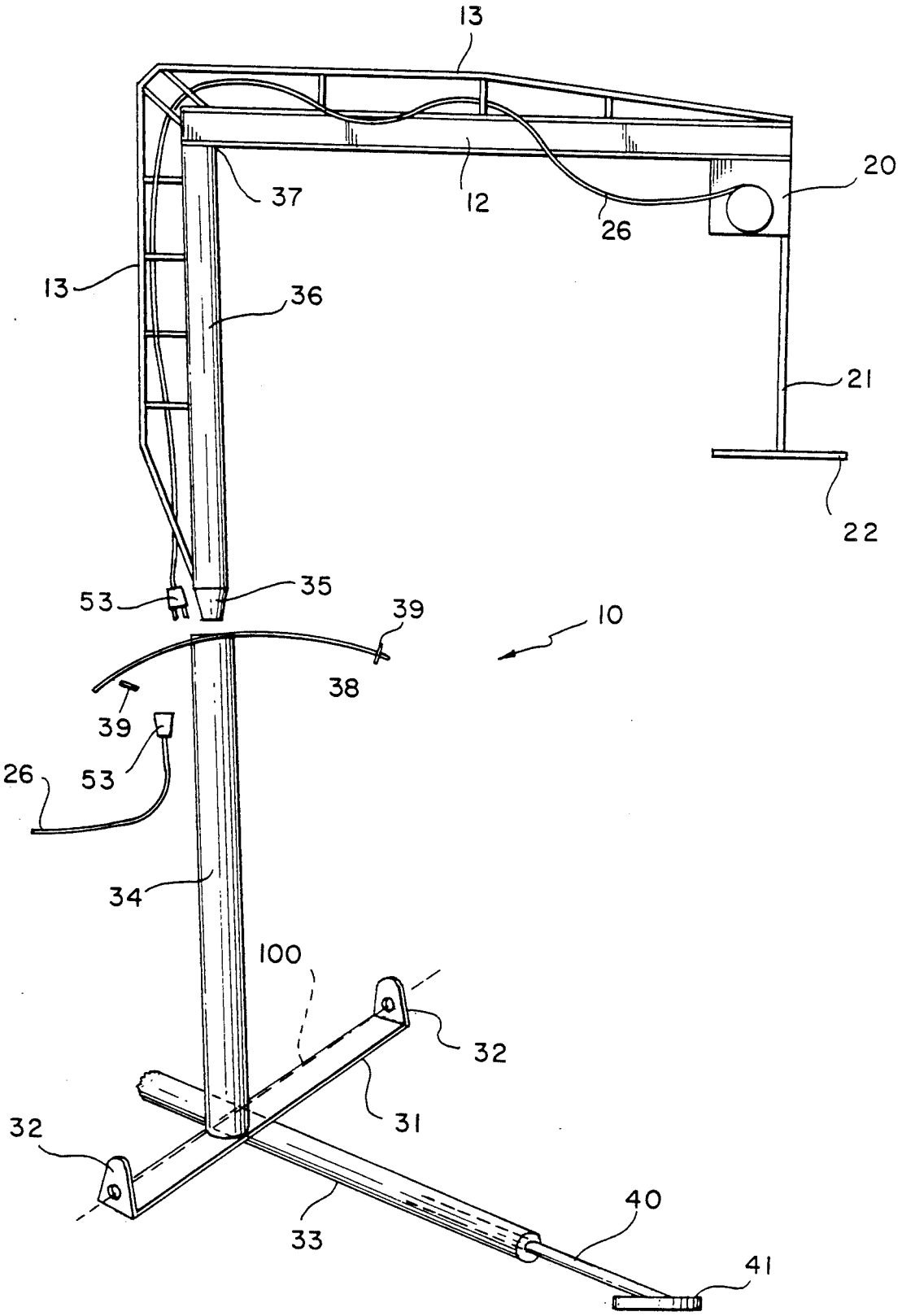
FIG. 3 is a perspective view of the frame of the device without the wheel chair showing the upper and lower vertical supports separated for travel purposes.

Referring now to the drawings and particularly to FIGS. 1 and 2, FIG. 1 shows a representative power driven wheelchair 1 of the type commonly provided for invalid patients. The wheel chair 1 had a seat bottom 2, a seat back 3, side drive wheels 4, two control wheels 5, two arm rests 6, and a battery power supply 7. Note that the power drive controls and motors are not shown for clarity and because these parts are not directly relevant to the operation of the invention.

The invention is attached to the wheelchair 1 such that the wheelchair acts as a structural support member with other support means (discussed below), and is, therefore, considered to be an integral part of the device.

The lift support 10 consists of two primary parts, a vertical support post 11, which is further divided into two pieces as discussed below. For this discussion, it is easier to view the support post 11 as one piece, and a catilever beam 12. Both the support post 11 and the cantilever beam 12 are formed of lightweight tubing material of steel or aluminum. To provide additional strength for the tubing, bracing members 13 are provided on both the support post 11 and the cantilever beam 12 as shown.

To support the weight of the patient when the patient is at the end of cantilever beam, and to prevent the wheelchair from tipping or moving unexpectedly, a telescoping outrigger 40 is provided. The outrigger extension 40 is attached to the frame of the wheelchair and is stored out of the way, under the seat. The outrigger is designed to extend to the floor. A circular pad 41 is connected to the bottom of the outrigger to ensure firm contact with the ground and to prevent slipping of the outrigger 40 or the wheelchair. The pad 41 is made from a rubberized material or other non-skid material.

The vertical support post 11 is designed to separate into two different parts to permit the chair to be taken on airplanes, vans, and other vehicles FIG. 3 shows a rear view of the wheelchair showing the vertical support post 11 separated for travel. The frame is discussed in detail below.

Figure 4:
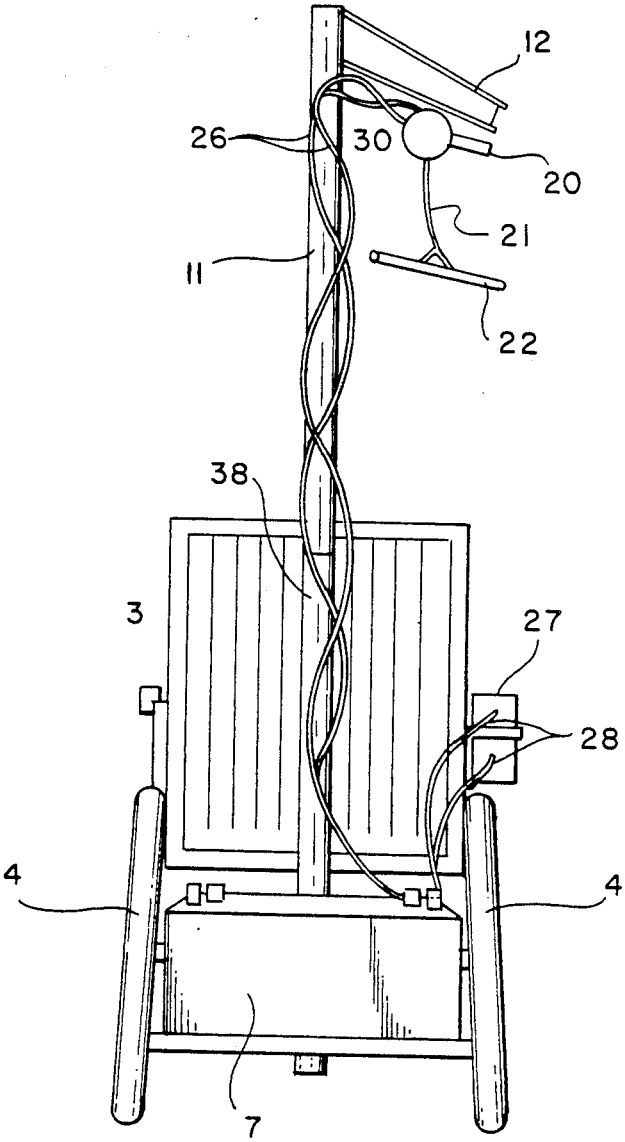
FIG. 4 is a rear view of the wheelchair and the device.

The cantilever beam 12 supports a lift motor 20, which is track mounted on the catilever bean 12 in a track 30 see FIG. 4. A lifting line 21 and a support bar 22 are connected to the motor drive to lift and lower patients as needed. A sling 23 (see FIG. 6) is attached to the support bar 22 to hold patients comfortably when the patient is being moved. The sling will be discussed in greater detail below.

Figure 5:
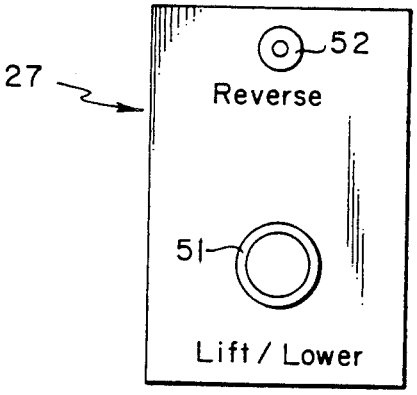
FIG. 5 is a detail view of the control box showing a typical switch arrangement.

The motor 20 is powered from a battery 7 located behind the wheelchair. Powered wheelchairs have such batteries installed as a matter of course. Power is supplied to the motor 20 through power cables 26. The power cables 26 are designed to extend to the end of the cantilever beam 12, when the motor 20 is fully extended (see FIG. 2). When the motor 20 is retracted as shown in FIG. 1, the power cables 26 are gathered and held in the vertical support post 11. The motor 20 is controlled by a switch 27 and control cables 28 (see FIGS. 1, 3 and 4). The control cables 28 are run with the power cables 26 as one cable to reduce bulk and to increase safety. The switch 27 is a simple push button momentary contact switch with a reversing button, housed in a small box that can be mounted on the wheelchair arm or attached to a tether suspended behind the chair an attached to the frame. The switch is shown in FIG. 5, the wiring is typical of a reversing motor and is well known in the art.

In the preferred embodiment, the motor 20 is only intended to raise or lower the patient. The patient, when suspended in a sling, is moved back and forth by sliding the motor in a track as discussed above. It is possible to install a separate drive motor to move the motor and patient along the track mechanically, but this is not preferred.

Referring now to FIG. 4 (note: FIG. 4 omits support braces 13 for clarity), the device forms a frame 10 that is attached to the chair at the axles and at the top of the chair back.

The bottom of the frame 10 is a lateral bar 31 the bar is placed over the axle 100 and is connected to the axle bolts at brackets 32. In practice, the wheels can be removed, or the bar 31 can be routed in such a manner so that the brackets fit over the axle and are secured by the wheel bolts. The outrigger frame 33 is attached to the bar 31 by welding or other fastening means applicable to the art. The outrigger extension 40 is slipped into the outrigger frame 33 and is held in place by friction. Because the angle of the outrigger and the floor is small (see FIG. 1), there is only a small lateral force on the outrigger extension 40 when it is extended, thereby reducing the tendency it may have to retract when the device is in use.

The lower vertical support post 34 is welded or otherwise attached to the lateral bar 31. The top of the upper vertical support 36 is tapered at 35, forming a post to allow the end to be placed inside the lower vertical support post 34. The end 35 of the upper vertical support post 36 is placed inside the post 34 and is held by friction. By placing the tapered end 35 on the upper support post 36, the lower support post 34 does not protrude above the top of the chair. Of course, there is no other limitation on reversing the connection of the posts.

The upper vertical support post 36 is welded at joint 37 to the cantilever beam 12.

A horizontal cross-member 38 is attached to the lower vertical support post as shown. The cross-member 38 is also welded or otherwise fixed to the vertical support post 34. The horizontal cross-member 38 has two brackets 39 as shown. The brackets are designed to be placed over the ends of the wheel chair handle frames. The cross-member 38 is curved to fit just behind the wheel chair back (see FIG. 4). The cross-member 38 is also placed just below the point of separation between the upper vertical support post 36 and the lower vertical support post 34. This is done to provide a clean, narrow profile for the upper part of the device when it is removed from the wheel chair, as well as to provide a stronger connection to the chair, thereby providing a safer lifting mechanism.

FIG. 5 shows a design for a typical control switch. The control switch 27 will have a push button momentary contact type switch 51 and a reversing switch 52. The different types of switch mechanisms available to achieve the same result are well known in the art and any similar type operating mechanism can be used to operate the motor 20.

The motor 20 is powered by the battery and the power cables 26 are attached to the positive and negative poles of the battery as per the motor wiring specifications and the control circuit design. The circuit design is well known in the art. The motor 20 is shown connected to the reversing switch 52 with cables 28. The momentary contact lift switch 51 is connected to the reversing switch to permit operation of the motor.

Figure 6:
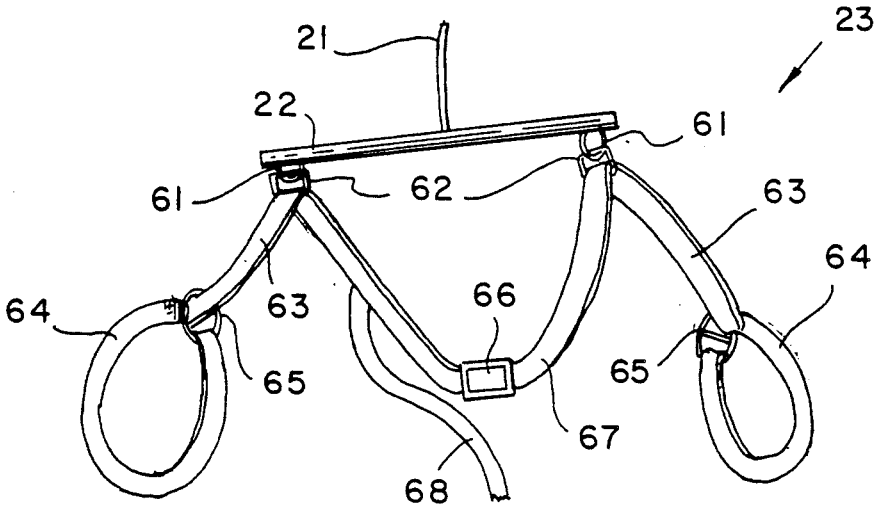
FIG. 6 shows the preferred sling design for use with device.

Referring now to FIG. 6, a sling 23 is shown that is preferred for use with the device. As with the switch, lifting slings are well known in the art and any similar lifting sling can be substituted. However, the preferred sling design consists of flexible members that are clipped to the lifting bar 22. Two rings 61 are placed near the ends of the lifting bar 22. The rings are used to clip the sling 23 into place on the lifting bar 22. The sling 23 is clipped to the lifting bar rings 61 by clips 62. The clips 61 are typical spring clips common to the art. The clips 61 are sewn or otherwise fastened to the sling material. A leg support strap 63 is attached to each clip 62 as shown. A leg strap 64 is attached to each leg support strap 63 as shown. The leg straps are attached to clips and rings 65. This allows the leg straps 65 to be placed around the patient's leg and then be simply clipped into place.

Extending from the other end of clips 62 are the back straps 67. The back straps are connected at buckle 66, which can be an ordinary seat buckle. The slack portion shown as 68 can be used to adjust the back straps 67 to ensure a comfortable fit. The leg straps 64 are not designed to adjust. This permits comfortable fit without the need for adjustments. Slack in the leg straps presents no problem in operation.

Figure 7:
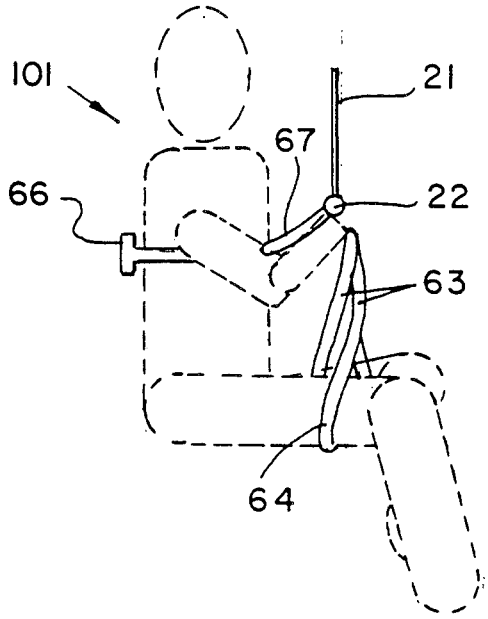
FIG. 7 is a detail view of the side view of the sling showing it in place on a person.

FIG. 7 shows how the sling is postioned on the patient. A typical patient 101 is placed between the lifting bar 22, which is held at chest level. The back straps 67 are brought around each side of the body and they are joined at the back of the patient by buckle 66 as shown. The leg support straps 63 are brought down to the patient's legs and the leg straps 64 are clipped in place around the patient's legs.

The advantages of this sling are an improved balance for the patient (the patient can hold the lifting bar 22). And the use of the back strap-leg strap combination leaves the patient's buttocks area exposed, which enables a patient to use toilet facilities without having to remove the sling.

To operate the device, the attendant will first extend the outrigger extension 40 to the floor and ensure that the pad 41 is firmly seated on the floor. Next, the sling 23 is placed around the patient, as discussed above, or, where alternative slings are used, over the patient's legs according to the sling design. The motor 20 is then placed in the retracted position and the support bar 22 is lowered until the sling can be attached to the support bar 22. The motor 20 is then reversed, lifting the support cable 21 and the patient. Once the patient is sufficiently raised, the motor 20 is slid along the track 30 until the patient is in the desired location. The motor 20 is then reversed again and the patient is lowered into the new position. To return the patient to the wheelchair, the opposite steps are performed.

To prepare the device for transportation, the control cables 26 and 28 are disconnected at plug 53. The upper portion of the device is then removed from post 34 until it is clear of the lower vertical support 34. The upper portion can then be placed along side the wheelchair in a van, or packed for shipment on an airplane. To reassemble the device, the opposite steps are taken, e.g., the upper portion of the device is placed into post 34 and slid into place and cable plug 53 is reconnected providing power to the motor.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change skilled persons within the scope of the invention without departing from the concept thereof.

I claim:

1. A lifting mechanism for use with a wheelchair having battery powered drive motors and drive wheels connected by an axle, and having a seat, a back and a frame comprising:

(a) a vertical support post, fixedly attached to the wheel chair frame;
(b) a cantilever beam fixedly attached to the vertical support post and extending radially therefrom;
(c) motor means slidably attached to said cantilever beam;
(d) lifting means attached to said motor such that when said motor is activated in a forward direction the lifting means extends from the motor and when said motor means is reversed, the lifting means retracts into said motor means;
(e) sling means removably attached to said lifting means;
(f) support means, extendably attached to said wheelchair whereby said support means extends to contact a floor surface when the lifting mechanism is in use and the support means retracts for storage at all other times;
(g) control means to operate said motor; and
(h) power supply means, integral to said wheel chair to provide the motor with electrical energy.

2. The lifting mechanism of claim 1 wherein said control means comprises a push button switch electrically connected between said power supply means and said motor means, and a reversing switch that is electrically connected between the push button switch and the motor means to reverse the direction of motor rotation.

3. The lifting mechanism of claim 1 wherein the power supply means comprises a battery mounted on the wheelchair.

4. The lifting mechanism of claim 1 wherein said support means comprises an outrigger support, extendably attached to said vertical support post such that the outrigger is extended to be in contact with a floor surface when the lifting mechanism is in use and the outrigger is retracted at all other times.

5. The lifting mechanism of claim 1 wherein said sling means comprises a pair of leg straps, each leg strap having clips and rings such that each strap can be closed into a loop by means of the clips and rings, said leg straps being connected to the lifting means, said sling also having an adjustable back strap having a lockable buckle means attached thereon, said back strp also being fixedly attached to said lifting means; said sling using said back strap and said leg straps in combination such that a patient is not impeded by operation of said sling when said patient is using toilet facilities.

6. A lifting machanism for use with a wheelchair having battery powered drive motors, and drive wheels connected by an axle, and having a seat, a back and a frame comprising:

(a) a vertical support post, fixedly attached to the wheel chair frame;
(b) a cantilever beam fixedly attached to the vertical support post and extending radially therefrom;
(c) track mean fixedly installed within said cantilever beam;
(d) motor means slidably attached to said track means;
(e) a lift cable attached to said motor such that when said motor is activated in a forward direction the lift cable is extended from the motor and when said lift cable is reversed, the lift cable is retracted into said motor;
(f) sling means removably attached to said lift cable;
(g) an outrigger support, extendably attached to said vertical support post such that the outrigger is extended to be in contact with a floor surface when the lifting mechanism is in use and the outrigger is retracted at all other times;
(h) control means to operate said motor; and
(i) power supply means, integral to said wheel chair to provide the motor with electrical energy.

7. The lifting mechanism of claim 6 wherein said control means comprises a push buttom switch electrically connected between said power supply means and said motor means; and a reversing switch that is electrically connected between the push button switch and the motor means to reverse the direction of motor rotation.

8. The lifting mechanism of claim 6 wherein the power supply means comprises a battery mounted on the wheelchair.

9. The lifting mechanism of claim 6 wherein said sling means comprises: a pair of leg straps, each leg strap having clips and rings such that each strap can be closed into a loop by means of the clips and rings, said leg straps being connected to the lifting means, said sling also having an adjustable back strap having a lockable buckle means attached thereon, said back strap also being fixedly attached to said lifting means; said sling using said back strap and said leg straps in combination such that a patient is not impleded by operation of said sling when said patient is using toilet facilities.

10. A lifting mechanism for use with wheelchairs having battery powered drive motors, and drive wheels connected by an axle and having a seat, a back and a frame comprising:

(a) a vertical support post, said vertical support post having a lateral axial support bar fixedly attached and being disposed perpendicularly to the axis of the vertical support post, the lateral axial support post being removable attached to the axle and being disposed between the drive wheels such that the vertical support post extends vertically with respect to the back of the wheel chair;

(b) a horizontal support bar being fixedly attached to the vertical support post and being disposed to align with the top of the wheel chair back and being removably connected thereto to provide lateral support for the vertical support post;

(c) a cantilever beam fixedly attached to the vertical support post and extending radially therefrom;

(d) track means fixedly attached to said cantilever beam;

(e) a motor, slidably attached to said track means whereby said motor can be positioned and moved freely along said track means, said motor being capable of operating in a forward and a reverse direction;

(f) a lifting cable attached to said motor whereby said motor will extend or retract the lifting cable;

(g) a support bar fixedly attached to said lifting cable;

(h) sling means, removably attached to said support bar;

(i) an outrigger support, extendably attached to said vertical support post such that the outrigger is extended to be in contact with a floor surface when the lifting mechanism is in use and the outrigger is retracted at all other times;

(j) control means to operate said motor in either a forward or a reverse direction as desired; and (k) a power supply, integral to said wheelchair, to operate said motor.

11. The lifting mechanism of claim 10 wherein said control means comprises a push button switch electrically connected between said power supply means and said motor means; and a reversing switch that is electrically connected between the push button switch and the motor means to reverse the direction of motor rotation.

12. The lifting mechanism of claim 10 wherein the power supply means comprises a battery mounted on the wheelchair.

13. The lifting mechanism of claim 10 wherein said sling means comprises: a pair of leg straps, each leg strap having clips and rings such that each strap can be closed into a loop by means of the clips and rings, said leg straps being connected to the lifting means, said sling also having an adjustable back strap having a lockable buckle means attached thereon, said back strap also being fixedly attached to said lifting means; said sling using said back strap and said leg straps in combination such that a patient is not impeded by operation of said sling when said patient is using toilet facilities.

* * * * *